US011407481B1

(12) United States Patent
Oliverio et al.

(10) Patent No.: US 11,407,481 B1
(45) Date of Patent: Aug. 9, 2022

(54) TROLLING MOTOR CONTROL SYSTEM

(71) Applicants: John David Oliverio, Brandon, FL (US); Nicholas Alexander Vicari, Tampa, FL (US); John Rayburn Pierce, Lynn Haven, FL (US); David Bailey, Riverview, FL (US)

(72) Inventors: John David Oliverio, Brandon, FL (US); Nicholas Alexander Vicari, Tampa, FL (US); John Rayburn Pierce, Lynn Haven, FL (US); David Bailey, Riverview, FL (US)

(73) Assignee: JLMARING SYSTEMS, INC, Tampa, FL (US)

( * ) Notice: Subject to any disclaimer, the term of this patent is extended or adjusted under 35 U.S.C. 154(b) by 260 days.

(21) Appl. No.: 16/873,845

(22) Filed: Jul. 23, 2020

Related U.S. Application Data

(60) Provisional application No. 62/922,190, filed on Jul. 26, 2019.

(51) Int. Cl.

| | |
|---|---|
| ***B63B 79/40*** | (2020.01) |
| ***B63B 79/10*** | (2020.01) |
| ***B63H 20/00*** | (2006.01) |

(52) U.S. Cl.
CPC ..... *B63B 79/40* (2020.01); *B63B 79/10* (2020.01); *B63H 20/007* (2013.01)

(58) Field of Classification Search
CPC ..... B63B 79/40; B63B 79/10; B63H 20/007
See application file for complete search history.

(56) References Cited

U.S. PATENT DOCUMENTS

| | | | | |
|---|---|---|---|---|
| 5,112,256 | A * | 5/1992 | Clement | B63C 9/0011 440/58 |
| 9,290,256 | B1 * | 3/2016 | Wireman | B63H 20/12 |
| 10,464,653 | B2 * | 11/2019 | Anderson | B63H 20/007 |
| 2011/0132181 | A1 * | 6/2011 | Kockovic | G10H 1/34 84/723 |
| 2019/0176950 | A1 * | 6/2019 | Whiteside | B63H 20/12 |
| 2020/0352001 | A1 * | 11/2020 | Lark, Jr. | G08B 21/18 |

* cited by examiner

*Primary Examiner* — Stephen P Avila
(74) *Attorney, Agent, or Firm* — Arthur W. Fisher, III

(57) ABSTRACT

A trolling motor control system to control the operation of a trolling motor including a rotatable propulsion support shaft to couple a propulsion unit to a boat including a plurality of modules and one or more control devices including a foot pedal control having a foot pedal pivotally mounted to the deck of the boat wherein the plurality of modules includes logic and circuitry to send and receive signals between the modules and to send and receive signals to and from the foot pedal control to synchronize or align the corresponding angular position of rotatable propulsion support shaft in the horizontal plane relative to the longitudinal axis of the boat with the angular position of the foot pedal control in the vertical plane relative to the deck of the boat and to generate tactile feedback to the pivotal foot pedal.

12 Claims, 15 Drawing Sheets

TROLLING MOTOR CONTROL SYSTEM

CROSS-REFERENCE

This is a utility application of provisional application Ser. No. 62/922,190, filed Jul. 26, 2019.

BACKGROUND OF THE INVENTION

Field of the Invention

A trolling motor steering system comprising a foot pedal control including sensors to generate a feedback signal to simulate external forces such as weeds or other obstructions encountered while trolling.

Description of the Prior Art

Fishing boats and other vessels are often equipped with a trolling motor for providing a relatively small amount of thrust to slowly and quietly propel the boat or vessel. They advantageously provide for a finer adjustment of watercraft position than a main motor/propeller combination. One example of a contemporary trolling motor system may be found at U.S. Pat. No. 7,722,417 to Bernloehr et al., the entire teachings and disclosure of which are incorporated by reference herein.

Trolling motors remain a viable and sought after apparatus for various applications, including but not limited to fishing, recreation, and commercial applications. Over time, two distinct steering configurations have become quite desirable, for different reasons.

The first is the cable steer configuration. Such configurations typically include a pedal with one or more control cables extending therefrom. As a user manipulates the position of the pedal, they also manipulate the control cables. The control cables are connected to a trolling motor assembly in a tensioned state, such that their movement causes a rotation of the trolling motor assembly to manipulate the direction of thrust provided by the trolling motor assembly. This allows the user to steer a watercraft incorporating the trolling motor assembly. An example of such a cable steer configuration may be seen at U.S. Pat. No. 5,465,633 to Bernloehr, the entire teachings and disclosure of which are incorporated by reference herein.

From the above, it will be recognized that such cable steer configurations are purely mechanical in their steering configuration such that the pedal is mechanically linked to the trolling motor assembly. As a result, movement of the pedal causes movement of the trolling motor assembly, and vice versa. As such, there is a tactile feedback provided in the pedal based upon the movement of the trolling motor assembly, as well as its angular orientation about a longitudinal axis extending along a length of trolling motor system. This tactile feedback has made such cable steer configurations desirable to many users, as it allows them to "feel" the position of the trolling motor assembly based upon the feedback at the pedal.

Second, there is the electronic steer configuration. Such wireless systems may utilize a pedal or other control, but instead of a mechanical linkage an electrical signal is provided to the trolling motor assembly based upon a user input to govern the steering of the trolling motor assembly. Such systems incorporate a steering motor which, upon receipt of the electrical signal, moves the trolling motor assembly to a desired position without the tactile feedback of mechanical cable configurations.

A trolling motor system with power steering and associated methods are provided. The trolling motor system includes a power steering module mounted to a mount of the trolling motor system. The power steering module is operable to rotate a trolling motor assembly of the trolling motor system about an axis thereof based upon at least one of a mechanical or an electrical input.

The trolling motor system includes a chassis adapted to be coupled to a boat, a housing pivotally coupled to the chassis, a lower propulsion unit, at least one shaft supported by the housing and coupled to the lower propulsion unit at a first end and a drive system including at least one actuator. The at least one shaft extends along a first axis. The first end is movable relative to the housing along the first axis. The drive system includes at least one actuator, a linear drive, a pivot drive and a coupler. The linear drive moves the first end of the first shaft along the first axis while the pivot drive pivots the housing about a second axis. The coupler connects the actuator and the pivot drive to pivot the housing. In one embodiment, the coupler connects the actuator and the pivot drive based upon the position of the at least one shaft along the first axis. In one embodiment, the system includes a foot control operator interface and a control circuit coupled to the operator interface and the linear drive. The control circuit generates control signals based upon input from the operator's foot which cause the linear drive to linearly move the at least one shaft. In one embodiment, the at least one shaft includes an inner shaft coupled to the lower propulsion unit and an outer shaft receiving the inner shaft.

An apparatus for controlling a trolling motor, comprising a foot operable control assembly with a rotatable plate operationally connected to the trolling motor so that the rotational motion of the plate will rotate the trolling motor to steer the boat. In one embodiment, the means to activate the trolling motor speeds are operationally connected to the trolling motor and placed in a circle around the rotatable control plate. In another embodiment the operator can place a chair on the rotatable plate to steer the boat and activate the trolling motor speeds with his foot.

In still another embodiment the control assembly has a rotatable shaft with a chair attached to steer the boat and the trolling motor speed control means are operatively connected to the trolling motor and placed remotely from the control assembly so that the speed control means are accessible to the foot of an operator. In the embodiments above the means operatively connecting the speed control assembly to the trolling motor comprises electric means but the speed control means may be operatively connected to the trolling motor by wireless electronic means, such as radio frequency, infrared signals or any other wireless means. Additionally, the means operatively connecting the trolling motor to the control assembly for controlling the rotation of the trolling motor on an axis to steer the boat are mechanical, but these means may be comprised of electrical or wireless electronic means, such as radio frequency, infrared signals or any other suitable means.

U.S. Pat. Nos. 5,892,338 and 6,054,831 disclose a remote control for trolling motors comprising a steering motor and foot pedal to control the rotational position of the trolling motor. The foot pedal includes a plurality of switches for commanding operation of the steering motor and trolling motor. The commands are transmitted via radio frequency to a receiver in the control head. The receiver decodes the commands and transfers the command to the control circuit.

U.S. Pat. No. 5,797,339 describes a system for remotely controlling the direction and speed of a trolling motor including a steering motor for turning the trolling motor. An operator may use a transmitter to generate a signal representing a desired direction and speed for the trolling motor.

U.S. Pat. No. 7,882,791 relates to a steering system for a motor to turn right or left as desired. A control unit instructs the steering system to turn the craft to desired orientation. A steering motor is activated that turns a cam attached to a shaft. The shaft is attached to the motor. The cam also includes an indent and sensors to indicate when the motor is in the fixed position or a secondary position that corresponds to a maximum angle for turning the motor. The steering system returns the motor back to the fixed position when the user indicates the steering system is to stop turning or when the secondary position is reached. The steering system returns the motor back to the fixed position without knowledge of the user. Thus, the motor stays in one of three positions unless instructed by the control unit to turn.

U.S. Pat. No. 5,121,889 teaches a six way foot control device including a toe portion pivotally mounted to a heel portion so that two directions of angular toe displacement may be realized about a neutral position. The heel portion is also pivotally mounted to permit two directions of sideways angular displacement about a corresponding second neutral point. Finally, the foot control is slidably mounted to permit two directions of linear displacement about a third neutral point. Each direction of displacement is detected by a transducer and may control another function of an aircraft or vehicle.

U.S. Pat. No. 4,614,900 and US 2003/0914921 show an electric trolling motor remotely controlled by a hand held or foot operated transmitter. The trolling motor and a turning or directional motor are connected through gearing to a trolling motor support shaft. The trolling motor operates in a straightaway propulsion mode or in left hand or right hand directional turning modes, all remotely controlled.

U.S. Pat. No. 4,152,703 shows a stepper motor to rotate an antenna toward a sending station and steers the driving motor to bring the vehicle to the transmitting station.

U.S. Pat. Nos. 5,112,256 and 5,171,173 relate to a servo controlled trolling motor steering system including an apparatus for mounting the motor on a boat for rotation about an axis to steer the boat. A foot pedal having a foot pad pivotally mounted to the base controls a desired steering direction. A membrane potentiometer senses rotational position of the motor to develop an electrical signal representative of the rotational position. A second membrane potentiometer senses pivotal position of the foot pad relative to the base to develop an electrical signal representative of the pivotal position, the signal comprising a steering command signal. A steering control is mounted to the mounting apparatus for steering the trolling motor, including a servo driven gear set for rotating the trolling motor and an electrical control responsive to the steering command signal and the steering feedback signal for actuating the servo to rotate the trolling motor to steer the boat.

U.S. Pat. No. 6,755,700 describes a foot-operated control to control the speed and steering of a trolling motor. A foot interface is pivotally connected at a base, the pivot separating and defining a first end and second end of the foot interface such that depressing the first end directs the trolling motor to steer the watercraft to the right and depressing the second end directs the trolling motor to steer the watercraft to the left.

U.S. Pat. No. 4,824,408 teaches a directional control mechanism for a boat controlled by extension and retraction of a control cable and a foot pedal. A pair of switch surfaces are disposed on opposite sides of the pedal, each surface extending above the pedal surface so that lateral movement of the user's foot when positioned on the pedal can contact one of the switch surfaces. A switch associated with each switch surface can then be activated for directionally moving the outboard motor into different positions responsive to pressure applied to one or other of the switch surfaces applied by the edge of the user's foot. The pedal and motor can be remotely placed with respect to one another such that the pedal "communicates" with the trolling motor using radio waves. In that embodiment, a transmitter is carried by the foot pedal or similar control, and a receiver positioned near the motor activates a reversible motor to steer the trolling motor, preferably by cable extension/retraction.

A steering system for a trolling motor includes a mechanical steering system having a mechanical steering input device and a mechanical linkage extending from the mechanical steering input device to a steering shaft of the trolling motor. Movement of the mechanical steering input device causes movement of the mechanical linkage, which in turn causes rotation of the steering shaft. An electromechanical actuation system is provided that is configured to be coupled to the mechanical steering system. A controller is in signal communication with the electromechanical actuation system and provides steering signals thereto. The electromechanical actuation system selectively actuates the mechanical steering system so as to rotate the steering shaft according to the steering signals provided by the controller. A method for steering a trolling motor is also provided.

Another example of the prior art relates to a remote-control, foot-operated unit for use with trolling motors on boats is revealed. The unit has a snap-together design that does not use screw fasteners extending through holes. As a result, the sensitive electronic components are completely sealed from contact with any water or water vapor. The snap design has a back-up feature to prevent accidental snap-release in the event of shock loading. The assembly fits together as a sandwich, effectively positioning a sealing component in juxtaposition with the snap arrangements to promote a secure connection around the periphery of the unit, as well as a tight sealing engagement between the sandwich components to, in effect, isolate the sensitive electronic components from exposure to any moisture.

A boat including a hull and a floor positioned within the hull. A pedal mount is secured to the floor. The pedal mount defines a pedal recess sized to receive a pedal for controlling a trolling motor.

A pontoon water craft having a hull with trolling mechanisms contained within the hull. The trolling mechanisms are contained in angled recesses provided in the pontoons. Control of the trolling mechanisms can be accomplished by using a control device which can actuate any one of the trolling mechanisms individually or any combination of trolling mechanisms which create a thrust or thrusts resulting in the desired movement of the water craft. The pontoons of the structure hull can help to insulate the trolling mechanisms such that noise is reduced.

While some of the prior art may contain some similarities relating to the present invention, none of them teach, suggested or include all of the advantages and unique features of the invention disclosed hereafter.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
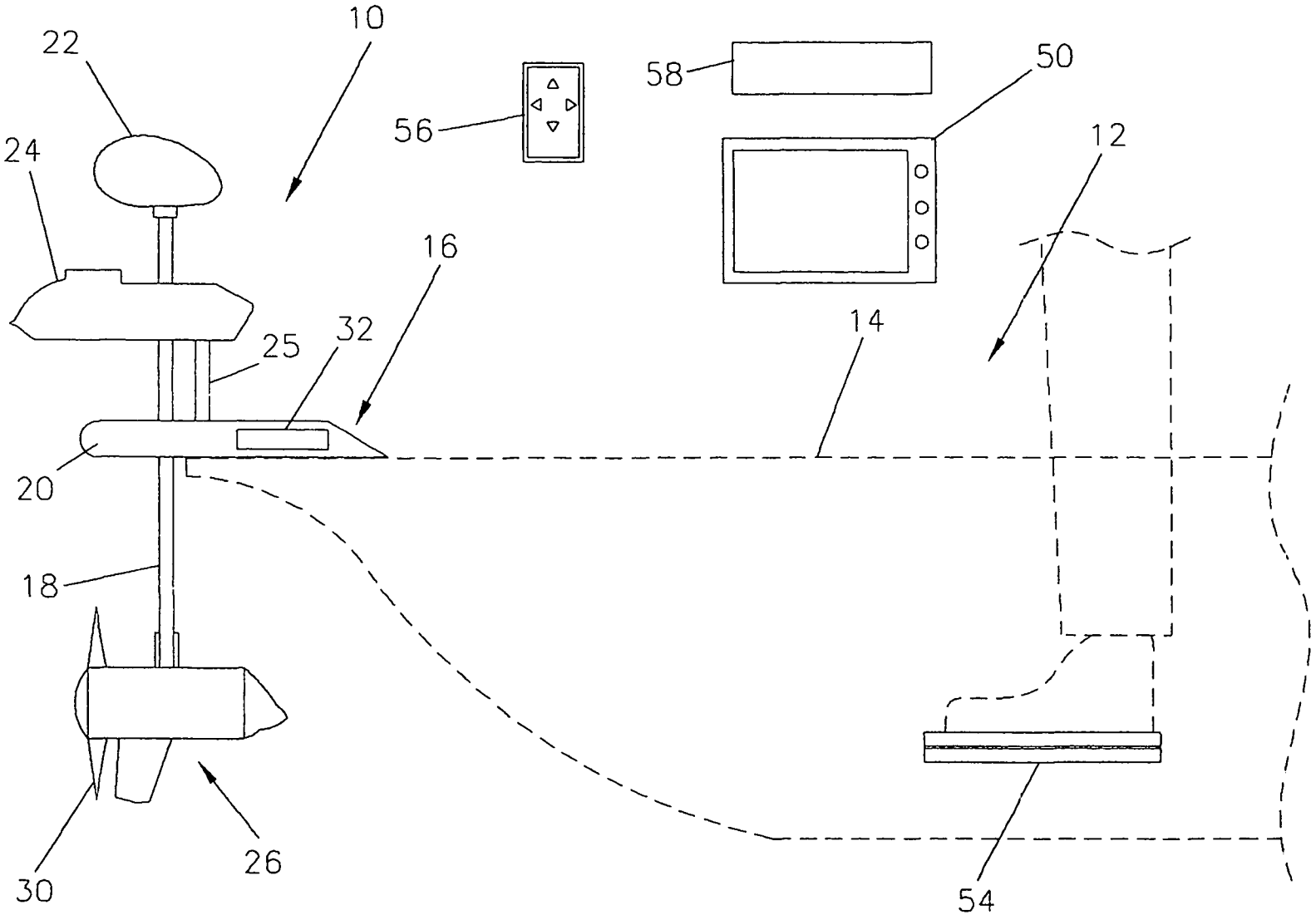
FIG. 1 is a side view of a trolling motor incorporating the trolling motor control system of the present invention mounted on a boat.
Figure 2:
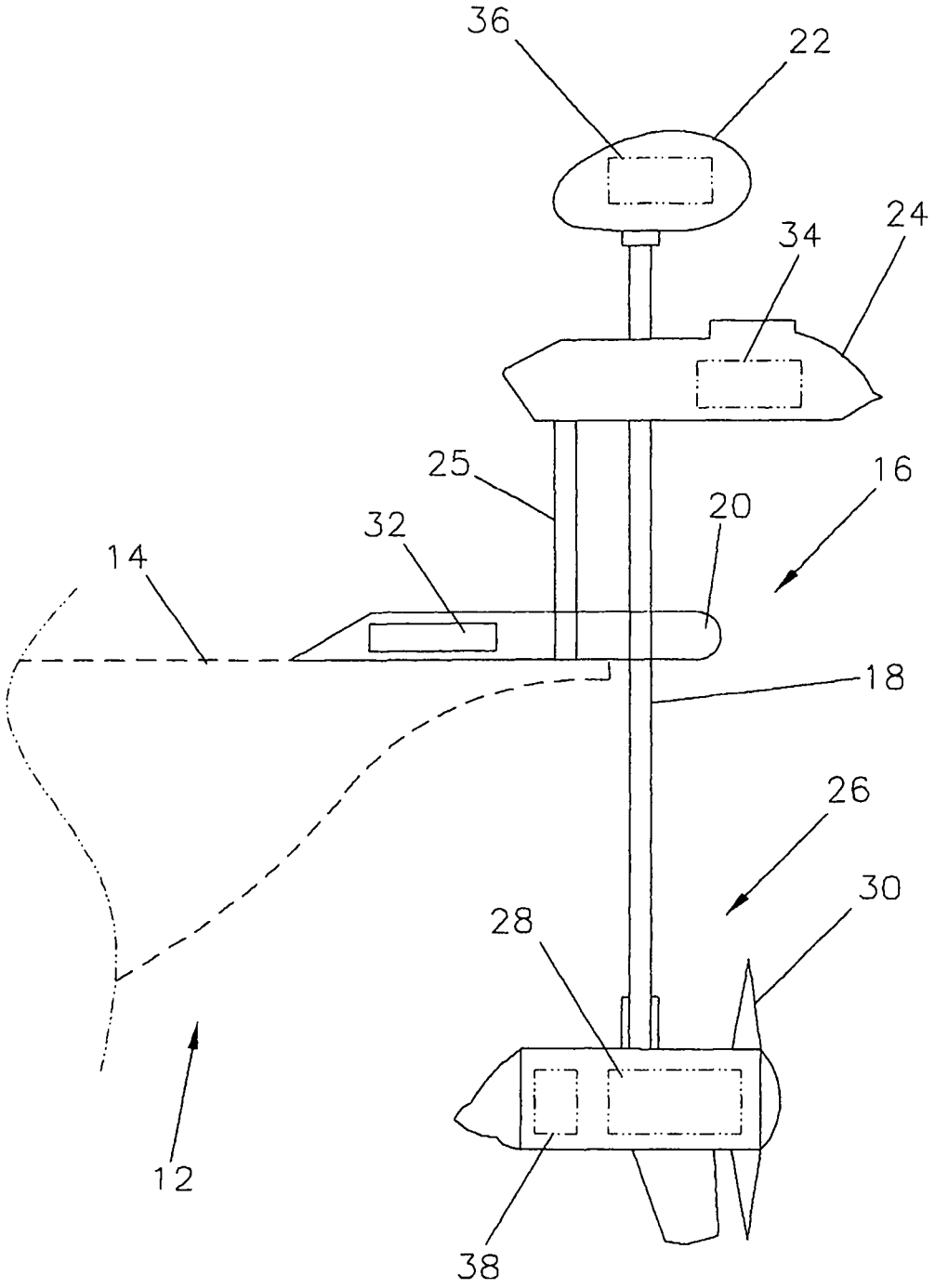
FIG. 2 is another side view of a trolling motor incorporating the trolling motor control system of the present invention.

The present invention relates to a trolling motor control system to monitor and control the steering operation of a trolling motor generally indicated as 10 in FIGS. 1 and 2 mounted on a boat generally indicated as 12 in FIG. 1. The overall architecture of the trolling motor control system comprises a system control including a plurality of modules having logic and circuitry to receive and/or transmit data and/or control signals between the modules of the system control and a plurality of input devices to control the direction of the boat.

As shown in FIG. 1, the trolling motor 10 is rotatably coupled to the deck 14 of the boat 12 by a motor mount generally indicated as 16. The trolling motor 10 comprises a propulsion support shaft 18 rotatably mounted to the distal portion 20 of the motor mount 16 having a head unit 22 and steering unit 24 coupled to the motor mount 16 by a support member or post 25 that includes a steering motor 87 (FIG. 5) mounted to the upper portion of the propulsion support shaft 18 and a propulsion unit generally indicated as 26 including a drive motor 28 and a propeller 30 affixed thereto mounted to the lower portion of the propulsion support shaft 18.

Figure 3:
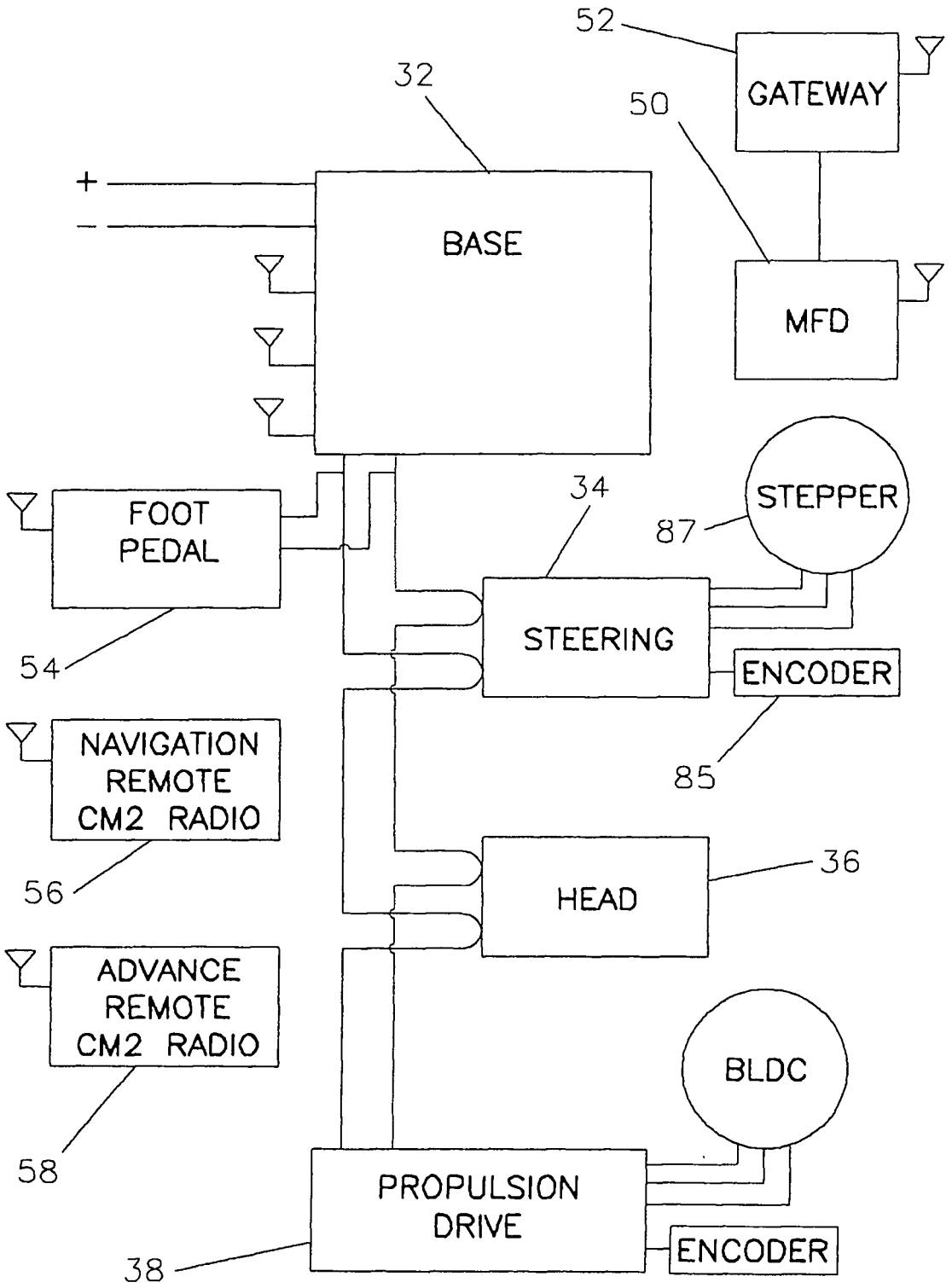
FIG. 3 is a schematic or block diagram of the trolling motor control system of the present invention.

FIG. 3 is a schematic or block diagram of the trolling motor control system comprising a system control including a base module or printed circuit board 32, a steering module or printed circuit board 34 located in the steering unit 24, head module or printed circuit board 36 located in the head unit 22 and a propulsion module or printed circuit board 38 located in the propulsion unit 26. The base module 32 located in the motor mount 16 on the deck 14 of the boat 12 and the steering module 34 located in the steering unit 24 coupled to the motor mount 16 or deck 14 by the support member or post 25 are configured to receive and/or transmit data and/or control signals between the modules of system control from one or more control devices such as a multi-function display and control device 50 coupled to a wireless gateway 52, a foot pedal control 54, a navigation control device 56 and an advanced navigation control device 58 as best shown in FIGS. 1 and 3. Each of the control devices 50, 54, 56 and 58 may be coupled to the base module 32 by hardwire or wireless. The remote control devices 50, 56 and 58 are capable of transmitting control signals to the steering module 34 and to receive signals from the steering module 34 indicating system operating status and haptic feedback as described hereinafter.

The frequencies of the various modules 32, 34, 36 and 38 of the trolling motor control system and remote control devices as depicted in FIG. 3 include 921 MHz assigned to JL Marine Systems, Inc. for CM2 radio, 927 MHz for PLC and 2.4 GHz for Bluetooth.

Figure 4:
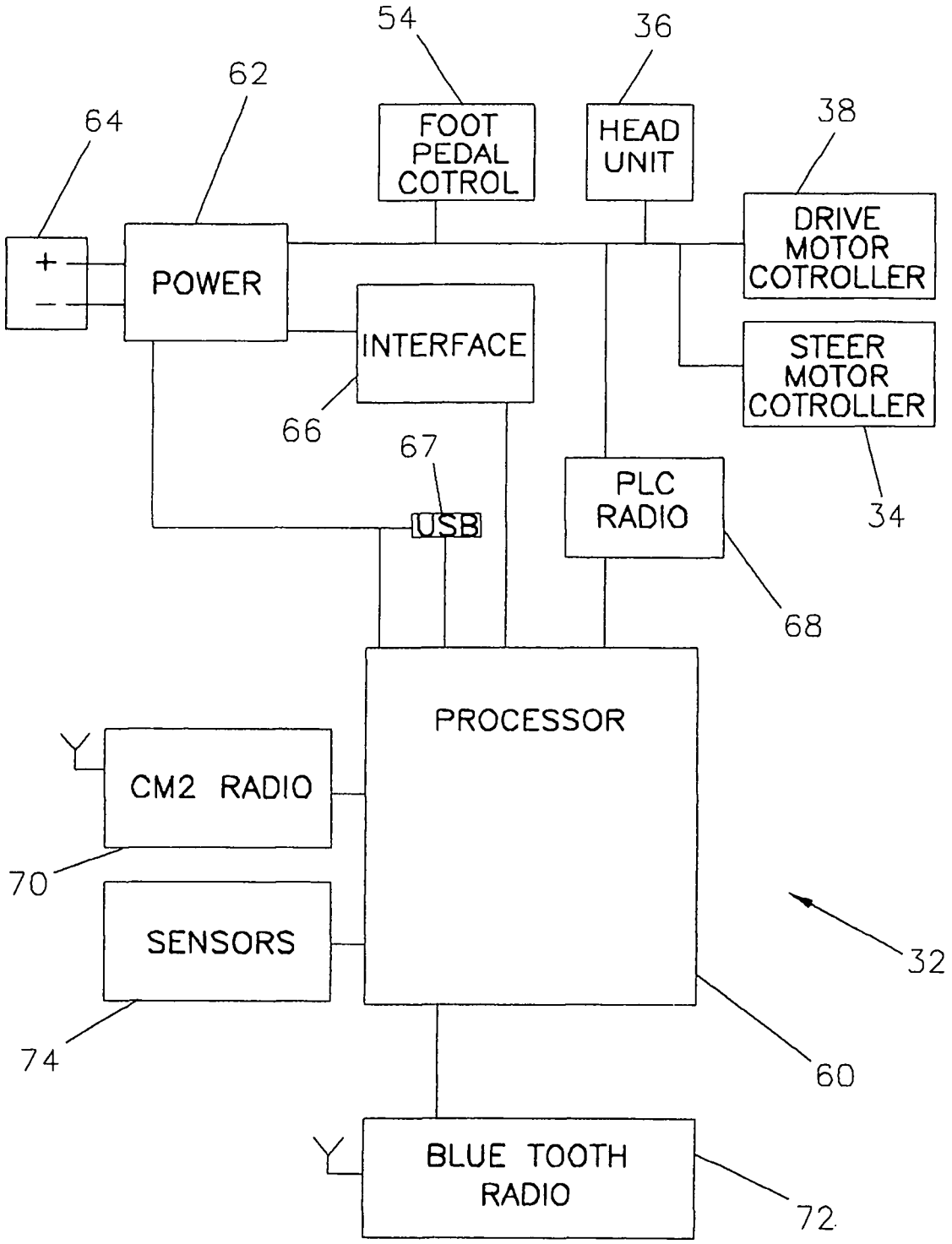
FIG. 4 is a schematic or block diagram of the base module of the present invention.

FIG. 4 is a schematic or block diagram of the base module 32 that includes a number of components such as power protection, current sensor, power relay, power management, CM2 radio, Hall magnetic switch, 9-axis micro-electromechanical sensor (MEMS) having a 3-axis accelerometer, a 3-axis magnetometer and a 3-axis gyroscope (MEMS), Bluetooth, and/or PLC interface. Systemwise, the base module 32 comprises a processor 60 including logic and circuitry capable of transmitting and receiving command signals and indications of system operating conditions with the steering module 34, head module 36 and propulsion module 38 as well as the multi-function display and control device 50, foot pedal control 54, navigation control 56 and advanced navigation control 58.

The base module 32 further comprises a power supply 62 coupled between a battery or power source 64 and the processor 60, an interface 66, a USB port 67 and a power-line communication medium (PLC) or radio 68. The processor 60 communicates with the various remote components wirelessly by either a radio 70 or Bluetooth 72. The base module 32 also comprises a nine-axis micro-electromechanical sensor (MEMS) 74 including a 3-axis accelerometer, a 3-axis magnetometer and a 3-axis gyroscope.

Figure 5:
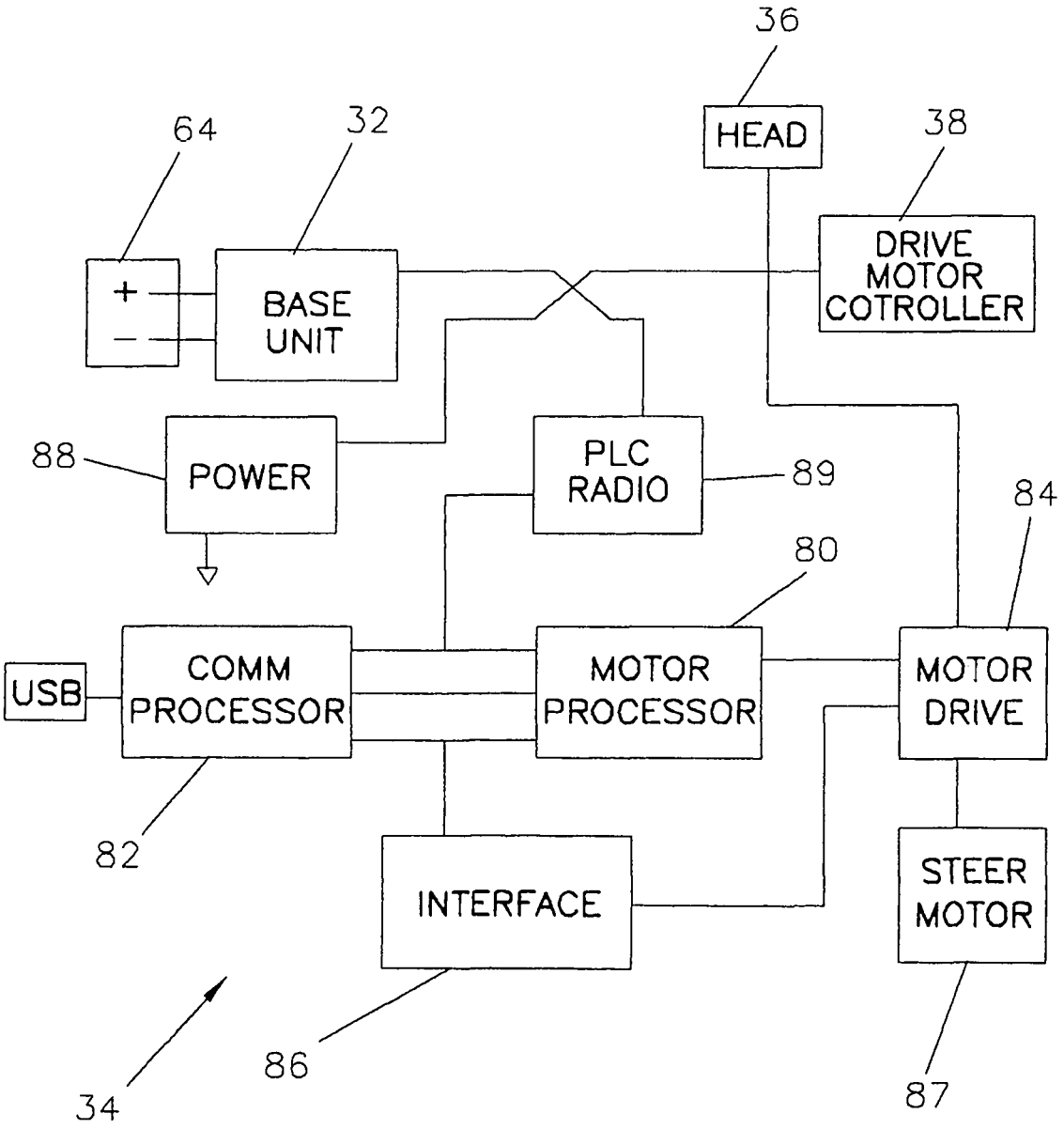
FIG. 5 is a schematic or block diagram of the steering module of the present invention.

FIG. 5 is a schematic or block diagram of the steering module 34 that includes a number of components such as steering driver, rotation sensor, current sensor, and/or PLC radio. Systemwise, the steering module 34 comprises a motor processor 80 including logic and circuitry capable of transmitting and receiving control signals and system operating status signals coupled between a communication processor 82 and a steering motor 87 operatively coupled to propulsion support shaft 18 to selectively rotate the propulsion support shaft 18 to control the direction of the trolling motor 10 sensed by the MEMS 96 in head module 36 or the heading of the boat 12 by the MEMS 74 in the base module 32 and including an encoder 85, an interface 86 coupled to the motor processor 80, a communication processor 82 having a USB port 83 and a motor drive 84 comprising an H-bridge drive with pulse width modulation or similar circuitry to control the operation of the variable torque, reversible motor 87 of the steering module 34 coupled to the base module 32. The steering module 34 further includes a power supply 88 coupled to the base module 32 and a PLC radio 89 coupled between the base module 32 and the motor processor 80 and the communication processor 82.

The propulsion support shaft 18 may be keyed or friction coupled to the steering motor 87. The encoder 85 and propulsion support shaft 18 are keyed or virtually locked together thereby eliminating slippage therebetween to provide an accurate position detector.

Figure 6:
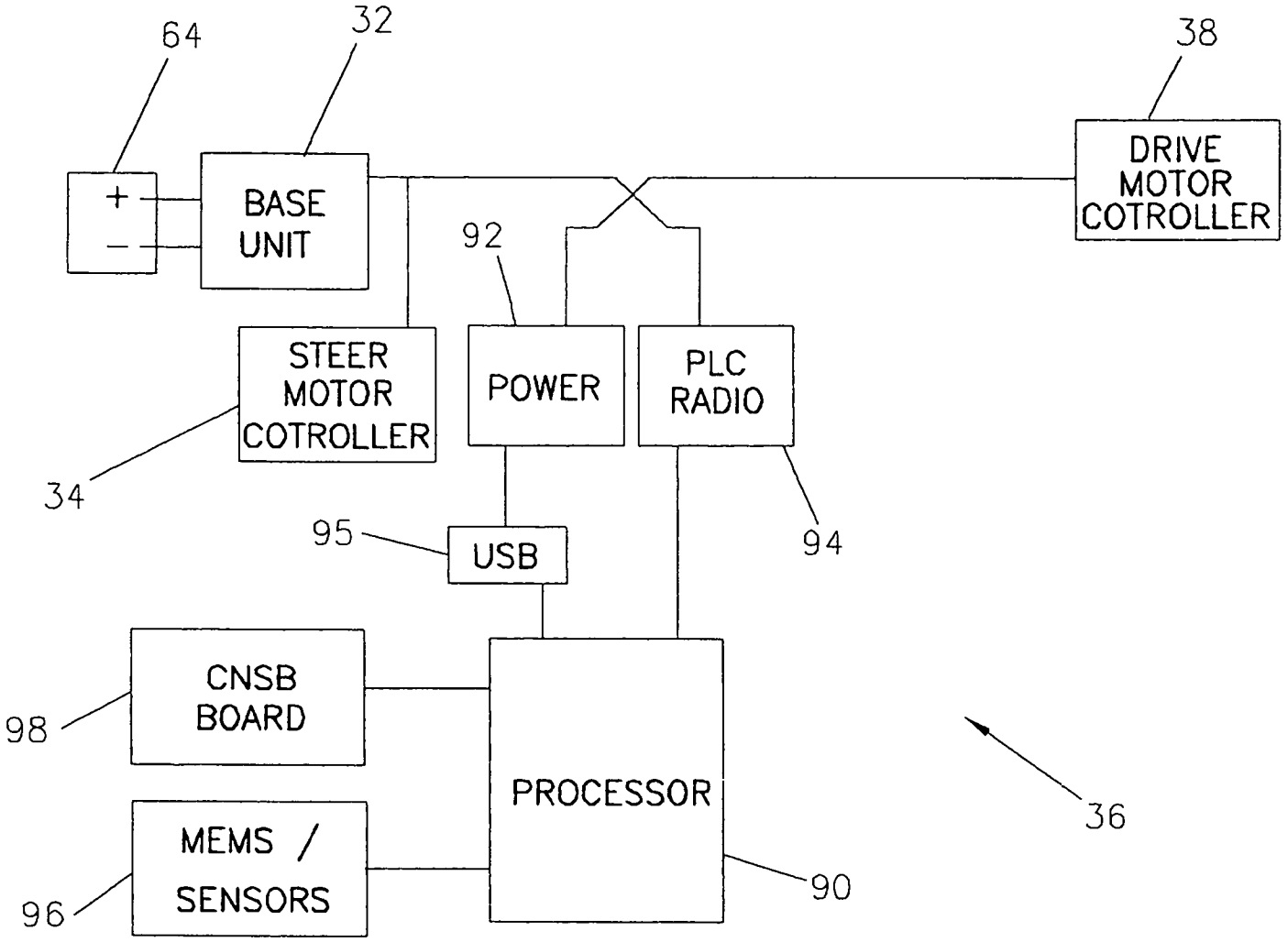
FIG. 6 is a schematic or block diagram of the head module of the present invention.

FIG. 6 is a schematic or block diagram of the head module 36 that includes a number of components such as LEDs, GNSS, 9-axis micro-electromechanical sensor (MEMS), and/or PLC interface. Systemwise, the head module comprises a processor 90 including logic and circuitry coupled to the base module 32 through a power supply 92 and PLC radio 94. The head module 36 further includes a nine-axis micro-electromechanical sensor (MEMS) 96 and GNSS board 98.

Figure 7:
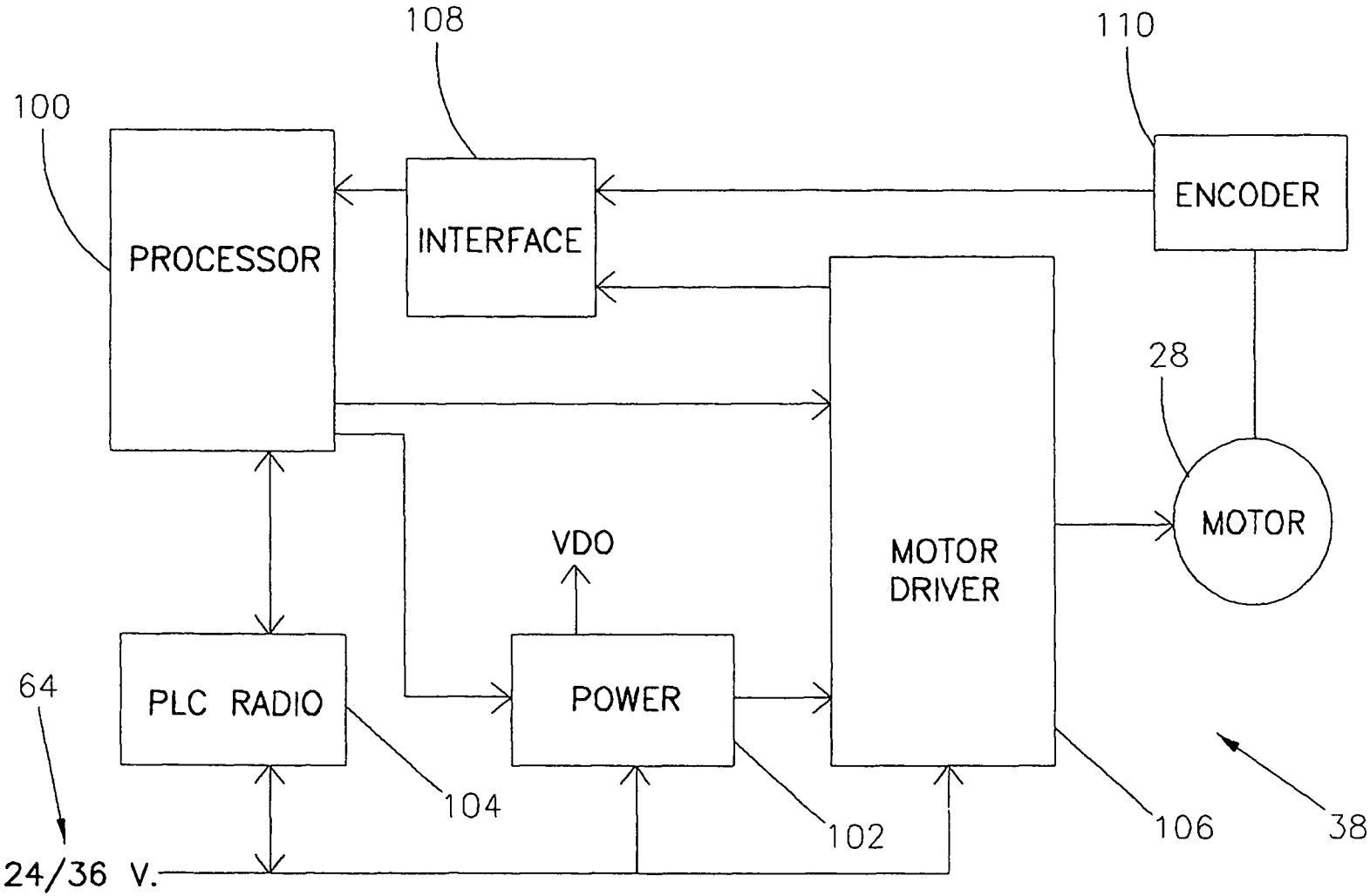
FIG. 7 is a schematic or block diagram of the propulsion module of the present invention.

FIG. 7 is a schematic or block diagram of the propulsion module 38 that includes a number of components such as BLDC driver, current sensor, and/or PLC interface. The propulsion module 38 comprises a processor 100 including logic and circuitry coupled to a power supply 102 and PLC radio 104. The propulsion module 38 further comprises a motor driver 106 coupled to the propulsion motor 28, an interface 108 coupled to the motor driver 106 and the processor 100 and an encoder 110 coupled between the propulsion motor 28 and the interface 108. The PLC radio 104, power supply 102 and motor drive 106 are coupled directly to the battery or power source 64.

Figure 8:
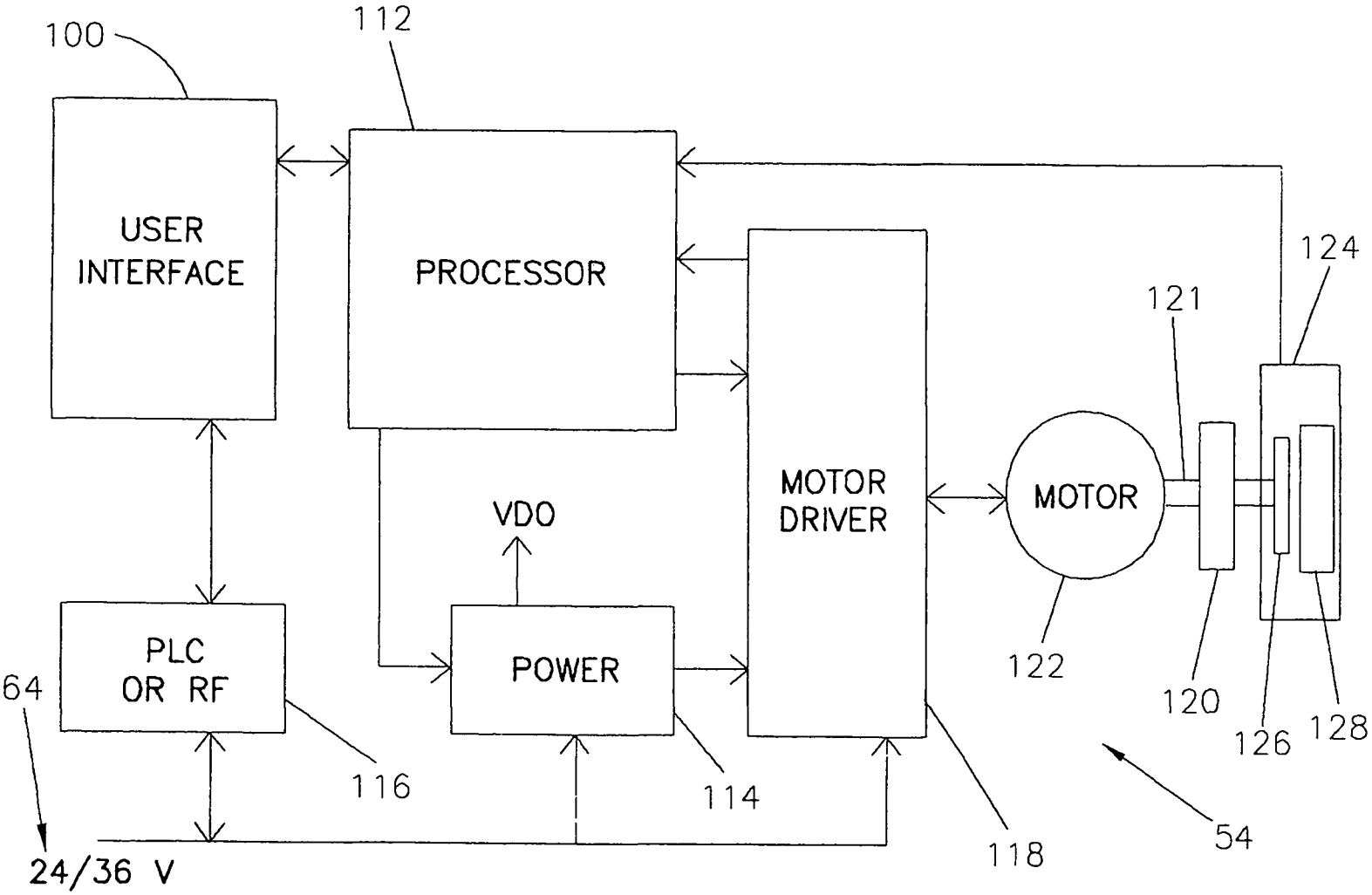
FIG. 8 is a schematic or block diagram of the foot pedal control device of the present invention.

FIG. 8 is a schematic or block diagram of the foot pedal module 54 comprising a processor 112 coupled to a power supply 114 and PLC radio or RF radio 116. The foot pedal module 54 further comprises a motor driver 118 coupled to a foot pedal 120 through a drive shaft 121 and motor 122, in turn, coupled through an encoder/sensor 124 to the processor 112 and a user interface 100 including control switches and displays. The PLC radio or RF radio 116, power supply 114 and motor drive 118 are coupled directly to the battery or power source 64. The foot pedal sensor 128 of the encoder/sensor 124 measures or senses the magnetic flux from magnet 126 affixed to the drive shaft 121 to derive the angular disposition or relationship of the foot pedal 120 relative to a deck 14 of the boat 12.

Figure 9:
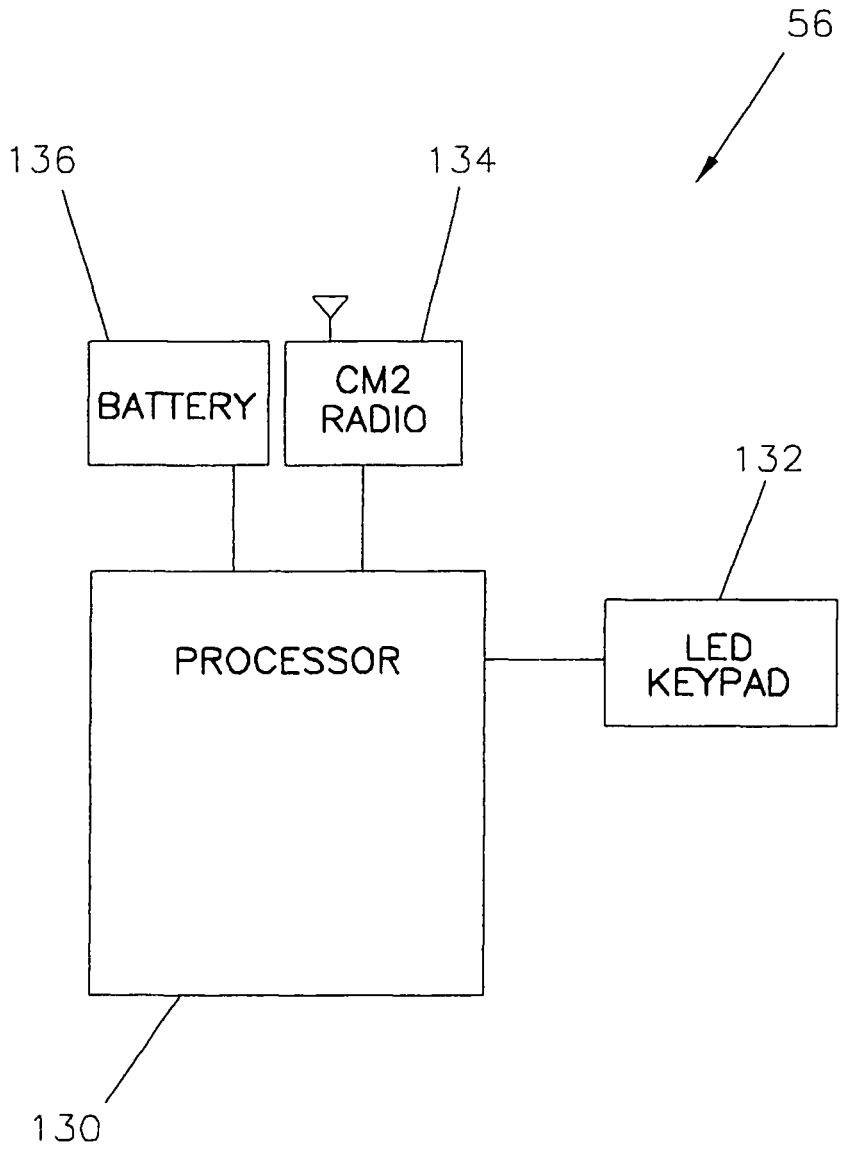
FIG. 9 is a schematic or block diagram of the navigation control device of the present invention.

FIG. 9 is a schematic or block diagram of the navigation device 56 comprising a processor 130 including logic and circuitry coupled to a LED keypad 132 and CM2 radio 134 and battery or power source 136.

Figure 10:
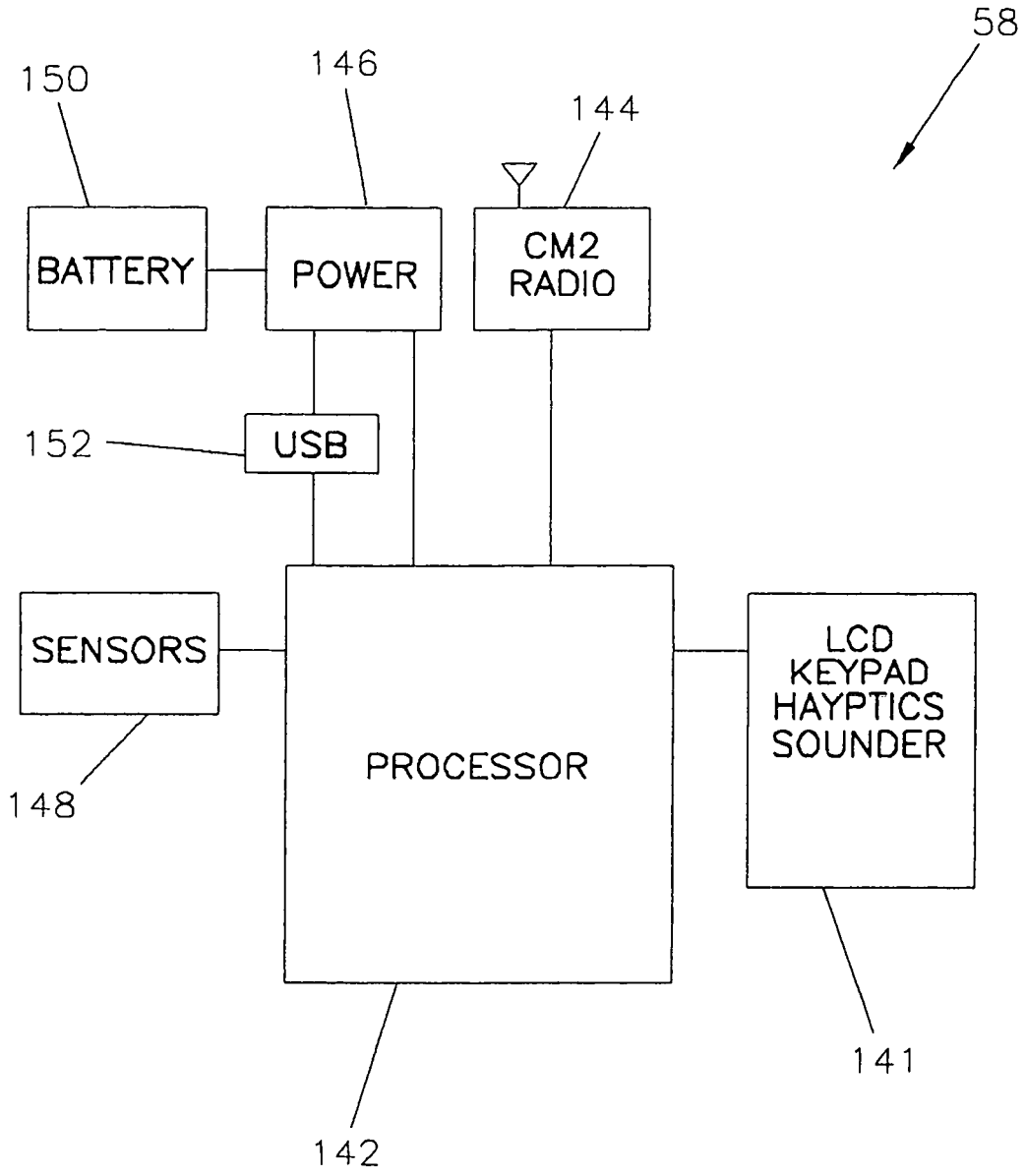
FIG. 10 is a schematic or block diagram of the advanced navigation control device of the present invention.

FIG. 10 is a schematic or block diagram of the advanced navigation device 58 comprising a processor 142 including logic and circuitry coupled to a LCD keypad 141, CM2 radio 144 and power supply 146 and sensors or 9-axis micro-electromechanical sensor (MEMS) 148. The advance control device 58 further includes a battery or power source 150 and USB port 152.

One of the primary functions or capabilities of the trolling motor control system is to align or synchronize the corresponding pivotal position of the foot pedal 120 and the rotational direction of trolling motor 10 to within a predetermined angular tolerance, to generate tactile feedback in the foot pedal 120 proportional to the angular difference, lag or lead, between longitudinal foot pedal drive shaft axis AA and the longitudinal propulsion support shaft axis BB calculated by the processor 60 of the base module 32 and a visual and tactile indication of the direction of the trolling motor 10 by the position of the foot pedal 120 relative to the deck 14 of the boat 12 and resistance to further depression or movement of only the foot pedal 120.

The angular range of rotation of the foot pedal 120 and the propulsion support shaft 18 are not equal. For example, the angular range of rotation of foot pedal 120 in the horizontal plane relative to the deck 14 maybe one hundred (100°) degrees; while the angular range of rotation of the propulsion support shaft 18 in the vertical plane may be two hundred (200°) degrees. Thus every one (1°) degree rotation of the foot pedal 120 should result in a two (2°) degree rotation of the propulsion support shaft 18. In order to compare the angular lead and lag relationships between the foot pedal position and the propulsion support shaft position, the processor 112 converts or calculates the sensed or encoded angular position or inclination of the foot pedal 120 relative to the deck 14 of the boat 12 to the equivalent angle of the propulsion support shaft 18 by multiplying the angle by two. In other words, there is a scaling relationship in calculating the angles to permit comparison. The calculated angle is then transmitted to the processor 60 of the base module 32.

Figure 15:
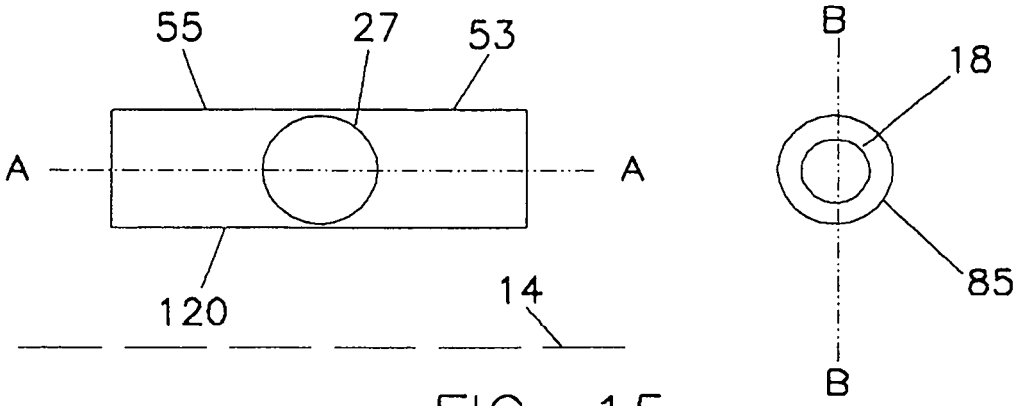
FIG. 15 is a graphic depiction of the foot pedal and propulsion support shaft in the neutral position.
Figure 16:
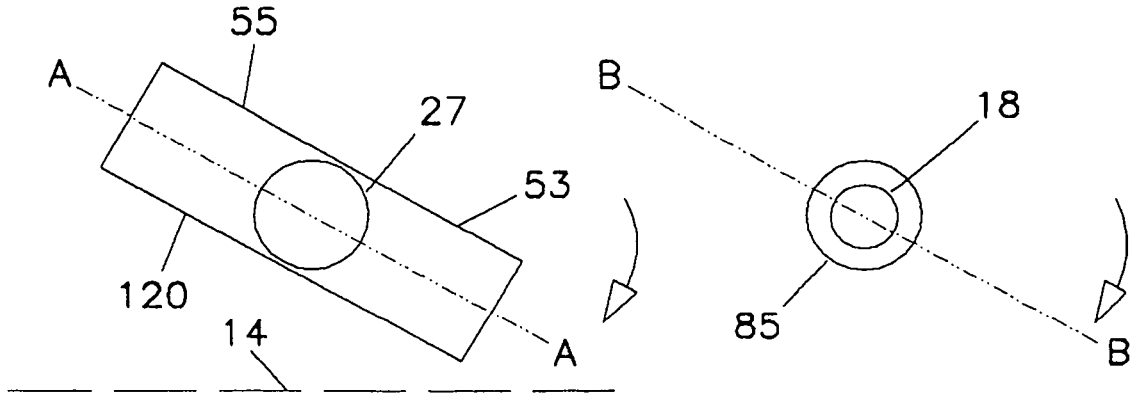
FIG. 16 is a graphic depiction of the foot pedal and propulsion support shaft fully rotated in one direction.
Figure 17:
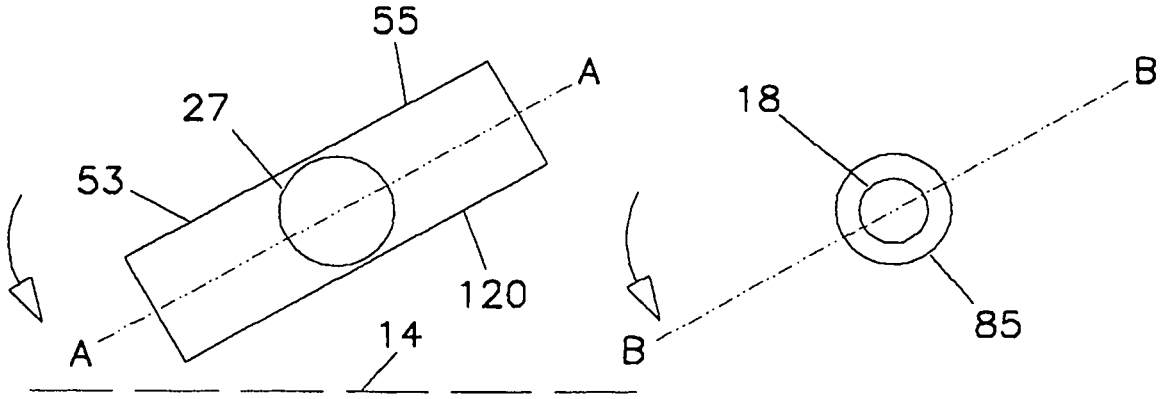
FIG. 17 is a graphic depiction of the foot pedal and propulsion support shaft fully rotated in the opposite direction from the position depicted in FIG. 16.

FIGS. 15 through 17 are graphic depictions of the pivotal and rotational positions of the foot pedal 120 coupled to the variable torque, reversible foot pedal motor 122 and the propulsion support shaft 18 coupled to the steering motor 87 when tracking to maintain or restore angular alignment between axis AA and axis BB.

To illustrate, depressing the front portion 53 of the foot pedal 120 pivots the foot pedal 120 from a first position shown in FIG. 15 to a second position shown in FIG. 16 causing the propulsion support shaft 18 to rotate clockwise from a first position shown in FIG. 15 to the position shown in FIG. 16. Similarly, depressing the back portion 55 of the foot pedal 120 pivots the foot pedal 120 from a first position shown in FIG. 15 to a second position shown in FIG. 17 causing the propulsion support shaft 18 to rotate counterclockwise from the first position shown in FIG. 15 to a second position shown in FIG. 17.

Of course, the foot pedal 120 may be pivoted to any position between the neutral or horizontal position depicted in FIG. 15 to either second position depicted in FIG. 16 or 17 with a corresponding scaled angular rotation of the rotatable propulsion support shaft 18 from the first or neutral position depicted in FIG. 15 to either second position depicted in FIG. 16 or 17.

Operation of the trolling motor control system is best understood with reference to FIGS. 11 through 17.

Figure 11:
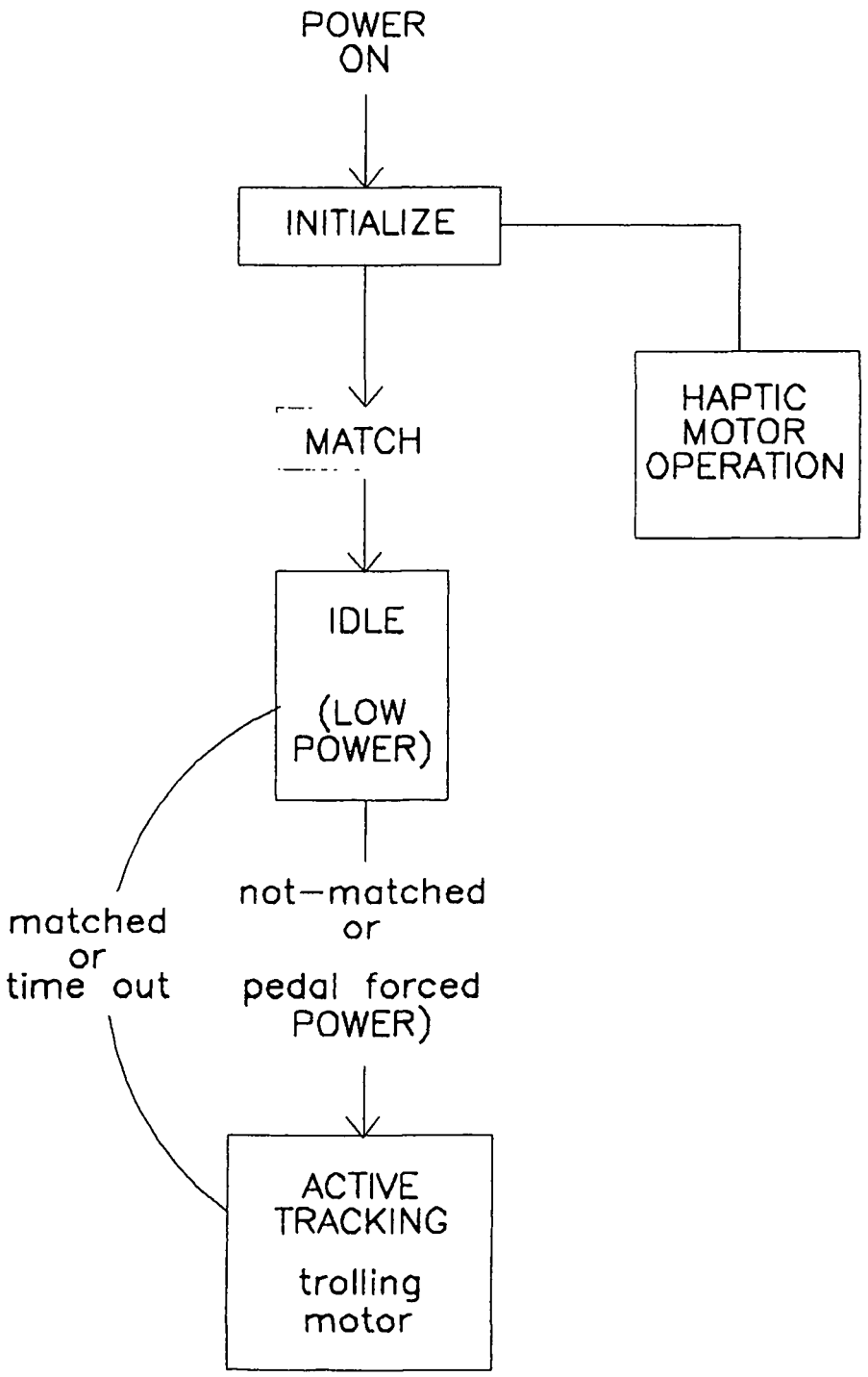
FIG. 11 is a flow chart of the foot pedal motor control states of the present invention.
Figure 12:
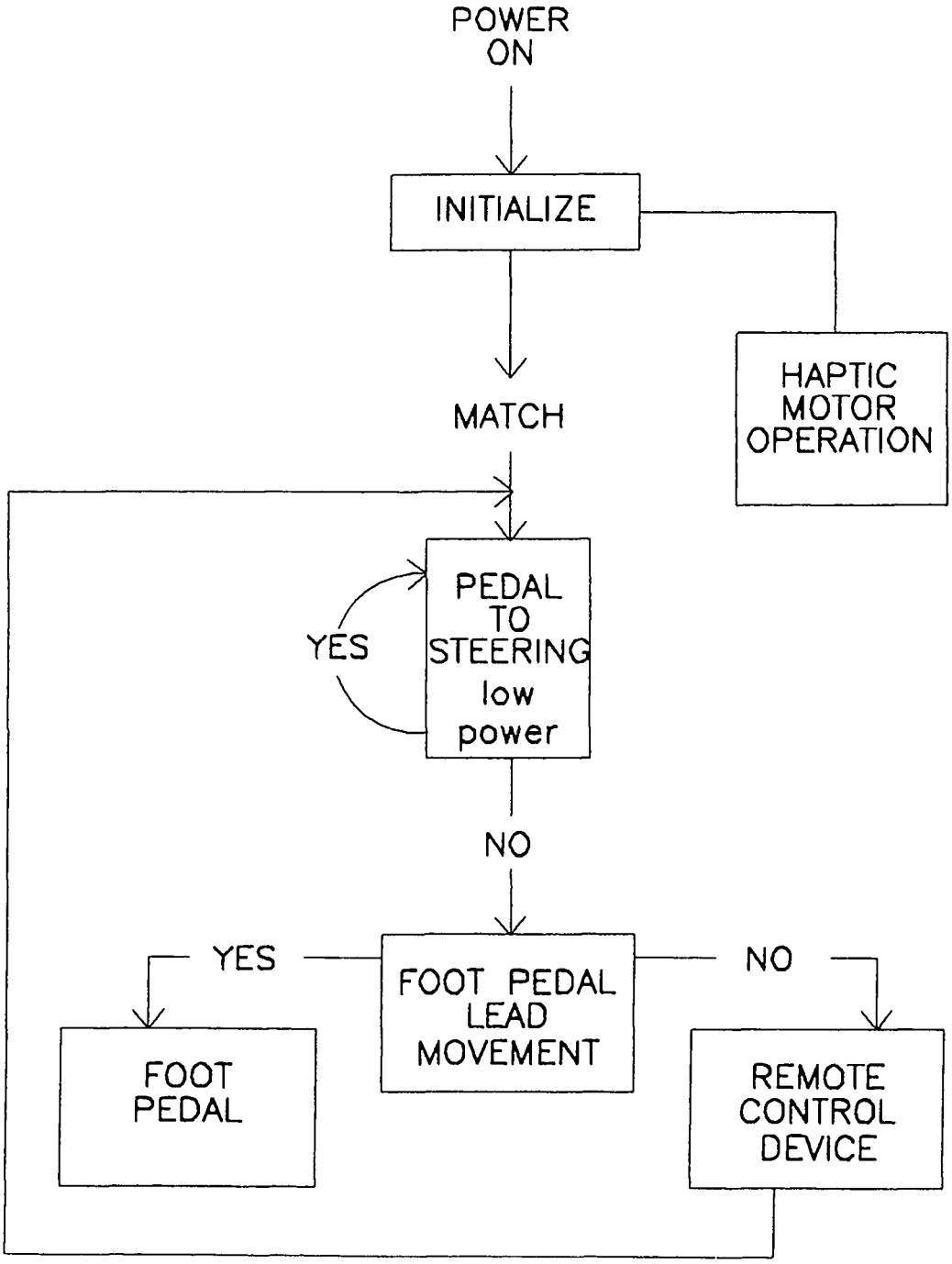
FIG. 12 is a flow chart of the foot pedal motor operation of the present invention.

As shown in FIG. 11, when powering up, the base module 32 initializes the internal components and circuitry of each module 32, 34, 36 and 38 as well as the control devices 50, 54, 56 and 58. Following initialization, the logic and circuitry of the steering module 34 aligns the axes AA and BB as illustrated in FIG. 15 by rotating the propulsion support shaft 18 until the steering encoder 85 of the steering module 34 such as a magnetic ring disposed to sense or read the rotational position of the steering motor 87 or the MEMS 96 of head module 36 senses the propulsion support shaft 18 is within the predetermined angular relationship between the propulsion support shaft 18 and the angular relationship or inclination of the foot pedal 120 relative to the deck 14 of the boat 12 mounted on the drive shaft 121 sensed by the foot pedal sensor 128 disposed to sense the position of the motor 122 and to be encoded by the encoder 124 and to generate and transmit a angular signal to the steering module 34. Once the relative angular disposition of the propulsion support shaft 18 and the foot pedal 120 is matched within the predetermined tolerance such as one (1°) degree, the trolling motor steering control system enters a low-power idle state. When the angular disposition of the propulsion support shaft 18 and the foot pedal 120 is no longer align with the predetermined tolerance or if the operator depresses the foot pedal 120, the trolling motor control system enters an active mode as described hereinafter to realign the angular disposition within tolerance or enter a time-out state.

Figure 13:
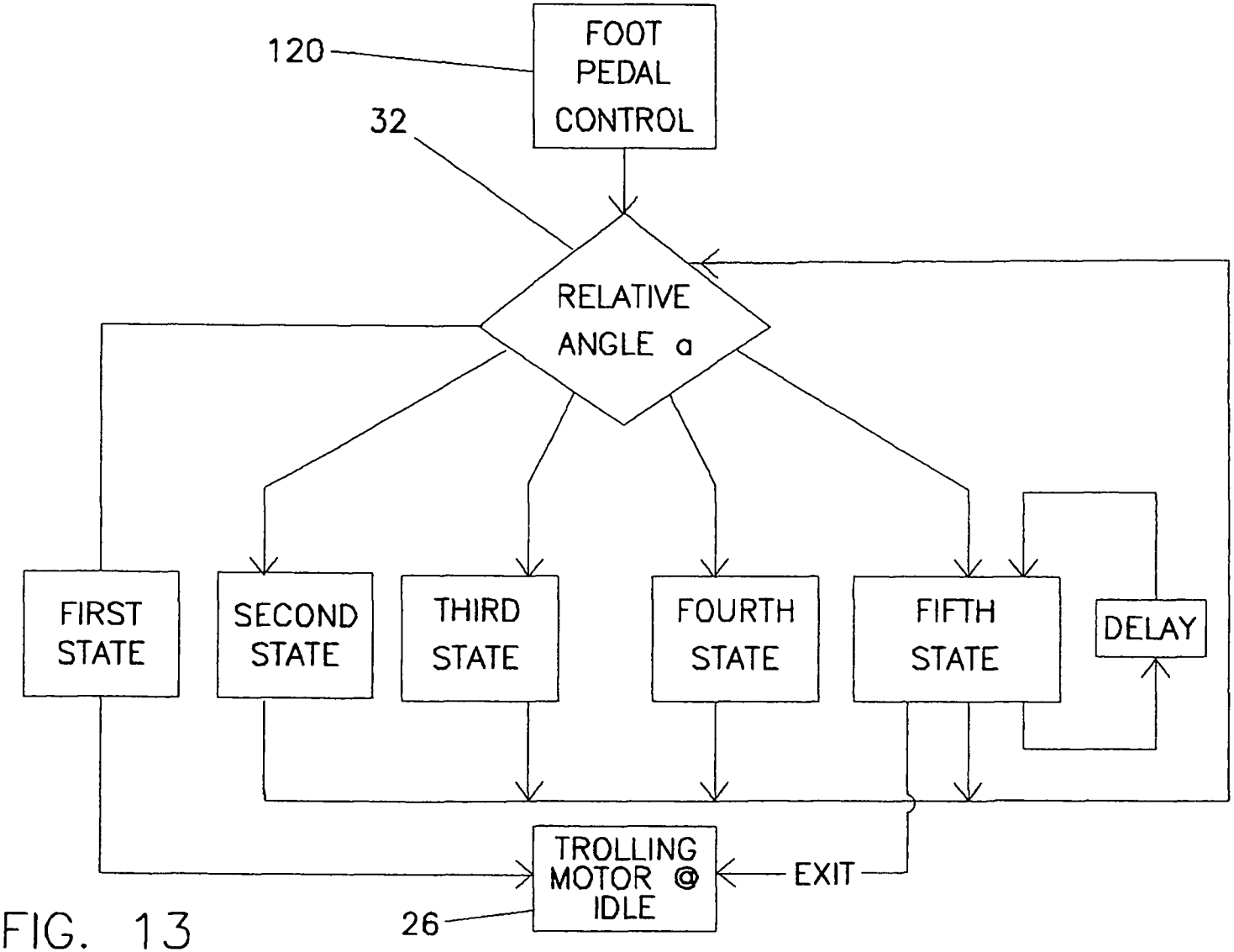
FIG. 13 is a flow chart of the foot pedal motor operation in the active foot pedal control mode of the present invention.

FIG. 13 illustrates operation of the trolling motor control system when operating in a first mode when the foot pedal control 54 and foot pedal 120 control the operation of the trolling motor control system. Specifically, the steering module 34 receives and compares the calculated or equivalent encoded signals from the foot pedal encoder 124 representative of the angular position of the foot pedal 120 of foot pedal control 54 with the angular position of propulsion support shaft 18 from the steering module 34 sensed by encoder 85 to calculate or determine the angular difference therebetween and to generate a feedback signal proportional to the scaled angular difference of the drive shaft 121 and propeller shaft 18.

The feedback signal generated by the foot pedal module 54 is fed to the foot pedal control 54. As described below operation of the foot pedal motor 122 is controlled by the feedback signal fed to the foot pedal motor 122 and force applied to the foot pedal 120 by the operator.

Variable torque generated by the foot pedal motor 122 applied to shaft 121 is directly proportional to difference in the angles of the foot pedal 120 and the propulsion support shaft 18 about the AA axis and BB axis respectively measured from the respective position or points of origin respectively. A plurality of states defined by the differences in the angles determine the feedback signal from foot pedal processor 112 to the foot pedal motor 122 of the foot pedal control 54 determines the resistance of movement of the foot pedal 120. This feedback signal controls the amount of torque applied to motor shaft 121 to generate a tactile resistance to depressing the foot pedal 120 proportional to the scaled difference between angular position of the foot pedal 120 and the angular position of the propulsion support shaft 18.

When in the first state the rotational alignment of the propulsion support shaft 18 lags the position the foot pedal 120 by a first predetermined value such as less than about one (1°) degree the foot pedal motor 122 does not exert any torque in the foot pedal shaft 121.

When in the second state the angular alignment of the foot propulsion support shaft 18 lags the foot pedal 120 by a first predetermined range such as from about one (1°) degree to about two (2°) degrees. In the second state there is no feedback signal and the foot pedal motor 122 does not exert any torque on the foot pedal shaft 121 to resist movement of the foot pedal 120.

When in the third state the angular alignment of the propulsion support shaft 18 lags the foot pedal 120 by a second predetermined range such as from about two (2°) degrees and to about three (3°) degrees. In the third state the foot pedal motor 122 generates a resistance torque on the foot pedal shaft 121 to create a first force on the foot pedal 120 to partially resist further movement of the foot pedal 120 by the operator by proportionally shunting foot pedal motor 122 with a duty cycle between 1% and 100% resisting rotation of pedal shaft 122 to resist movement of the foot pedal 120. For example, at about 2.01° the resistance or force may be about 1%, at about 2.50° the resistance or force may be about 50% and at about 2.99° the resistance or force may be about 99%.

When in the fourth state the angular alignment of the propulsion support shaft 18 lags the foot pedal 120 by a third predetermined range such as from about three (3°) degrees to about four (4°) degrees. In the fourth state the foot pedal motor 122 generates a torque on the shaft 121 by electrically energizing foot pedal motor 122 proportionally with a duty cycle between 1% and 100% applying torque to the foot pedal shaft 121 to create a second force greater than the first force on the foot pedal 120 to further resist further movement of the foot pedal 120.

When in the fifth state the angular alignment with the propulsion support shaft 18 lags the foot pedal 120 by a fourth predetermined range such as from about four (4°) degrees or greater. In this state, the foot pedal motor 118 will short out the foot pedal motor 122 applying passive brakes to motor shaft 121 and the foot pedal 120 to resist further movement of the foot pedal 120 and conserve power.

Figure 14:
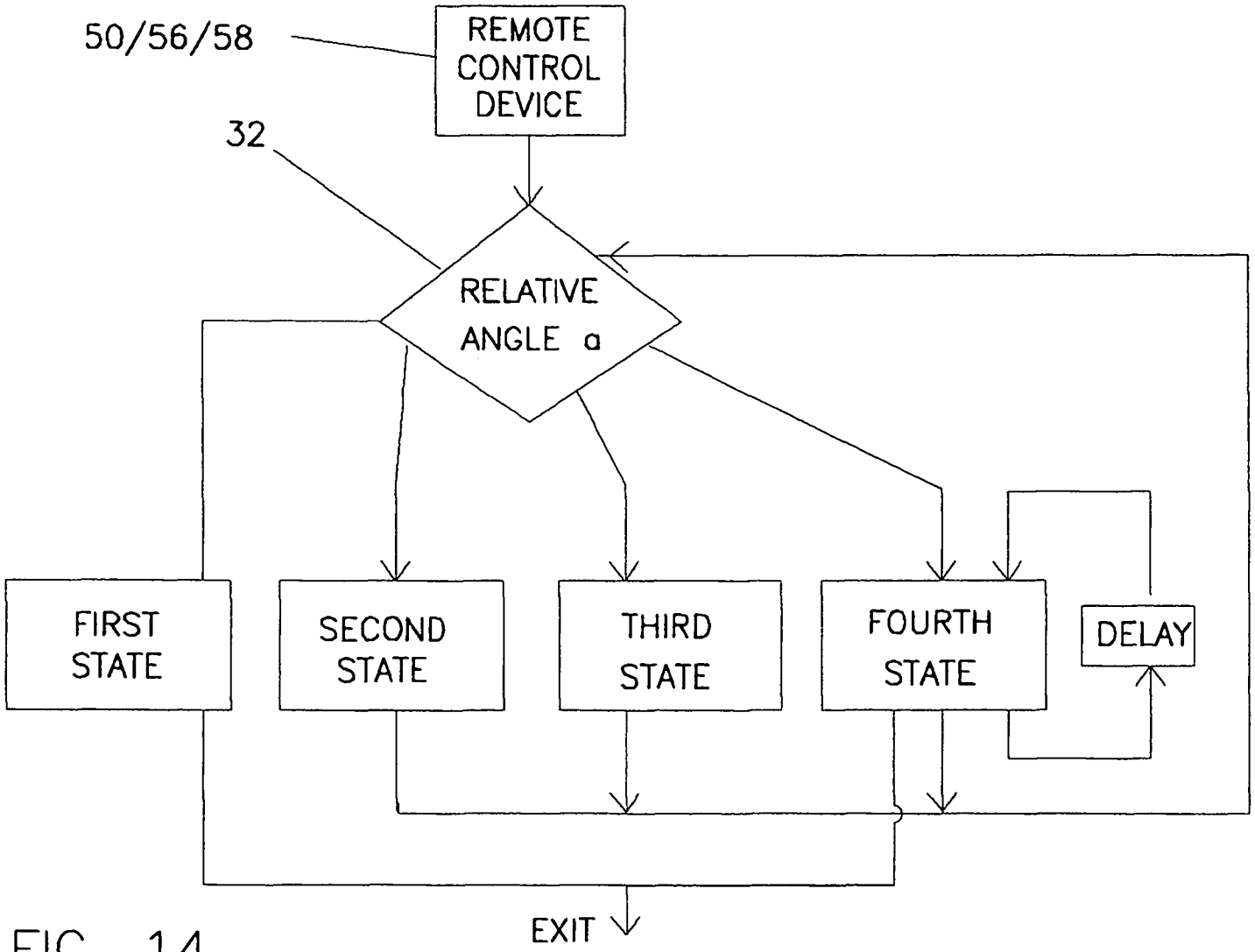
FIG. 14 is a flow chart of the foot pedal motor operation in the active remote control device mode of the present invention.

FIG. 14 illustrates operation of the trolling motor control system in a second mode when any of the other remote control devices 50, 56 or 58 control operation of the trolling motor control system. The trolling motor control system in the second mode operates in a manner similar to the trolling motor control system when operating in the first mode except the control signals feed through the base module 32 to the steering module 34 are received from the remote control devices 50, 56 or 58. As a result, the angular position of the propulsion support shaft 18 is first determined or established. The angular position of the foot pedal 120 is then derived or calculated to follow or align with the corresponding angular position of the propulsion support shaft 18 as controlled by the active remote control devices 50, 56 or 58.

In particular, when in the first state the angular alignment of the propulsion support shaft 18 leads the position the foot pedal 120 by a first predetermined value such as less than about one (1°) degree the foot pedal motor 122 does not exert any torque on the foot pedal shaft 121.

When in the second state the angular alignment of the propulsion support shaft 18 leads the foot pedal 120 by more than about one (n degree the foot pedal motor 122 will operate in the forward mode to rotate the angular position of the foot pedal 120 corresponding to that of the propulsion support shaft 18.

When in the third state the angular alignment of the propulsion support shaft 18 lags the position of the foot pedal 120 by more than about one (1°) degree the foot pedal motor 122 will operate in the reverse mode to rotate the angular position of the foot pedal to that of the propulsion support shaft 18.

When in the fourth state the angular alignment between the propulsion support shaft 18 and the foot pedal 120 is greater than about four (4°) degrees the foot pedal motor 118 will completely short out the motor applying passive brakes to the motor shaft 121 and the foot pedal 120 to release any further movement of the foot pedal 120 and conserve power.

The trolling motor control system may also be capable of controlling the foot pedal motor 122 and the variable torque, reversible motor 87 by sensing the acceleration or rate of change of the angular relationship of the foot pedal 120 and the propulsion support shaft 18 to generate a directly proportional motor torque feedback signal to foot pedal motor 120 or variable torque reversable motor 87 operating in first mode or second mode.

The trolling motor control system is also capable of generating a haptic signal if the trolling motor 10 encounters weeds, lily pads or other physical obstruction, such as hitting a log, sand bar or the like or even a broken propeller blade.

For example, when propeller 30 is caught in weeds or other vegetation the propeller 30 may slow causing the current in the motor 28 to change feeding an obstruction signal from the propulsion module 38, or MEMS 96 acceleration gyro characteristic of the obstruction to the base module 32 or steering module 34 where the obstruction signal is compared to a table of predetermination profiles and generates a haptic signal corresponding to the encountered obstruction. This haptic signal is fed to the foot pedal control 54 causes the foot pedal 120 to chatter or other physical movement characteristics of the obstruction encountered and even stop the pedal motor 122 locking or freezing the foot pedal 120 in position preventing further movement. Haptic signals may also be fed to the other control devices 50, 56 and/or 58 that are capable of generating a signal corresponding to the obstruction encountered.

The base module 32 and steering module 34 each include MEMS that sense the absolute heading of the boat 12 and the absolute direction of the trolling motor 10; that is, angle between the center-line of the boat and center axis of the propulsion support shaft (transmitted to the base module 32) respectively; while, the absolute angle between the plane of the foot pedal 120 and the deck 14 of the boat 12 is measured or sensed by the foot pedal sensor 128 sensing the angular position of the foot pedal shaft 120 relative to the deck 14 of the boat 12 and encoded by an encoder 124 and transmitted to the base module 32.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

What is claimed is:

1. A trolling motor control system to control the operation of a trolling motor including a rotatable propulsion support shaft mounted to the distal portion of a motor mount having a head unit and steering unit coupled to the motor mount by a support member or post including a steering motor mounted to an upper portion of said rotatable propulsion support shaft and a propulsion unit including a drive motor and a propeller affixed thereto mounted to a lower portion of said rotatable propulsion support shaft, a system control including a plurality of modules having at least one control device including a foot pedal control having a foot pedal pivotally mounted to the deck of the boat wherein said plurality of modules includes logic and circuitry to send and receive signals between said modules and to send and receive signals to and from said foot pedal control to synchronize or align a corresponding angular position of rotatable propulsion support shaft in the horizontal plane relative to the longitudinal axis of the boat with the angular position of said pedal control in the vertical plane relative to the deck of the boat and to generate tactile feedback proportional to the difference between the angular position of said rotatable propulsion support shaft relative to the longitudinal axis of the boat and the angular position of said foot pedal relative to the deck of the boat.

2. The trolling motor control system of claim 1 wherein said plurality of modules includes a base module, a steering module located in said steering unit, a head module located in said head unit and a propulsion module.

3. The trolling motor control system of claim 2 wherein a remote-control device to transmit control signals to said steering module and to receive signals from said steering module indicating system operating status.

4. The trolling motor control system of claim 2 wherein a base module and said steering module are configured to receive and/or transmit data and/or control signals between said modules of system control from at least one said control device.

5. The trolling motor control system of claim 4 wherein said base module comprises a processor including logic and circuitry to transmit and receive command signals and indications of system operating conditions with said steering module, said head module and said propulsion module.

6. The trolling motor control system of claim 5 wherein said base module comprises a multifunction display control device and foot pedal control.

7. The trolling motor control system of claim 5 wherein said base module further comprises a multi-axis micro-electromechanical sensor including an accelerometer, a magnetometer and a gyroscope.

8. The trolling motor control system of claim 2 wherein said steering module includes a steering driver, rotation sensor, current sensor, and/or radio and further comprises a motor processor including logic and circuitry to transmit and receive control signals and system operating status signals coupled between a communication processor and the steering motor operatively coupled to said rotatable propulsion support shaft to selective rotate said propulsion support shaft to control the direction of said trolling motor sensed by multi-axis micro-electromechanical sensor in said head module or the heading of the boat by said multi-axis micro-electromechanical sensor in said base module.

9. The trolling motor control system of claim 2 wherein said head module includes a processor including logic and circuitry coupled to said base module and radio and said head module further includes a multi-axis micro-electromechanical sensor.

10. The trolling motor control system of claim 2 wherein said propulsion module includes logic and circuitry coupled to a power supply and radio and said propulsion module further comprises a motor driver coupled to said propulsion motor, an interface coupled to said motor driver and said processor and an encoder coupled between the propulsion motor and said interface.

11. The trolling motor control system of claim 2 wherein said foot pedal module comprises a processor coupled to a power supply and a motor driver coupled to a foot pedal through a drive shaft and motor coupled through an encoder/sensor to said processor.

12. The trolling motor control system of claim 11 wherein said foot pedal module further comprises a user interface including control switches and displays and motor drive are coupled to a power source wherein said foot pedal sensor of the encoder/sensor measures or senses the magnetic flux from a magnet affixed to the drive shaft to derive the angular disposition or relationship of said foot pedal relative to a deck of the boat.

* * * * *